US012065721B2

(12) United States Patent
Bach et al.

(10) Patent No.: US 12,065,721 B2
(45) Date of Patent: Aug. 20, 2024

(54) METHOD OF MANUFACTURING A 2XXX-SERIES ALUMINIUM ALLOY PLATE PRODUCT HAVING IMPROVED FATIGUE FAILURE RESISTANCE

(71) Applicant: Aleris Rolled Products Germany GmbH, Koblenz (DE)

(72) Inventors: Andreas Harald Bach, Koblenz (DE); Sabine Maria Spangel, Koblenz (DE); Philippe Meyer, Koblenz (DE); Achim Bürger, Hohr-Grenzhausen (DE)

(73) Assignee: NOVELIS KOBLENZ GMBH, Koblenz (DE)

( * ) Notice: Subject to any disclaimer, the term of this patent is extended or adjusted under 35 U.S.C. 154(b) by 665 days.

(21) Appl. No.: 17/277,436

(22) PCT Filed: Oct. 23, 2019

(86) PCT No.: PCT/EP2019/078844
§ 371 (c)(1),
(2) Date: Mar. 18, 2021

(87) PCT Pub. No.: WO2020/089007
PCT Pub. Date: May 7, 2020

(65) Prior Publication Data

US 2022/0033937 A1 Feb. 3, 2022

(30) Foreign Application Priority Data

Oct. 31, 2018 (EP) ..... 18203683

(51) Int. Cl.

| | |
|---|---|
| ***C22C 21/18*** | (2006.01) |
| ***C21D 9/46*** | (2006.01) |
| ***C22C 21/14*** | (2006.01) |
| ***C22C 21/16*** | (2006.01) |
| ***C22F 1/05*** | (2006.01) |
| ***C22F 1/057*** | (2006.01) |

(52) U.S. Cl.
CPC ..... *C22C 21/18* (2013.01); *C21D 9/46* (2013.01); *C22C 21/14* (2013.01); *C22C 21/16* (2013.01); *C22F 1/057* (2013.01)

(58) Field of Classification Search
CPC ..... C22F 1/057; C22C 21/16; C22C 21/18
See application file for complete search history.

(56) References Cited

U.S. PATENT DOCUMENTS

| | | | | |
|---|---|---|---|---|
| 5,213,639 | A | 5/1993 | Colvin et al. | |
| 5,582,660 | A * | 12/1996 | Erickson | C22C 21/02 148/552 |
| 5,938,867 | A | 8/1999 | Dorward et al. | |
| 6,277,219 | B1 | 8/2001 | Heinz et al. | |
| 2008/0121317 | A1 | 5/2008 | Benedictus et al. | |
| 2009/0159159 | A1 | 6/2009 | Danielou et al. | |
| 2011/0250469 | A1 | 10/2011 | De Smet et al. | |

FOREIGN PATENT DOCUMENTS

| | | |
|---|---|---|
| CN | 1331762 | 1/2002 |
| CN | 1396295 | 2/2003 |
| CN | 101410540 | 4/2009 |
| CN | 103045921 | 4/2013 |
| CN | 104372269 | 2/2015 |
| CN | 103589977 | 11/2015 |
| CN | 105441839 | 3/2016 |
| CN | 106480384 | 3/2017 |
| CN | 106637008 | 5/2017 |
| CN | 106756539 | 5/2017 |
| EP | 0031605 A2 | 7/1981 |
| EP | 0473122 | 12/2004 |
| FR | 2843755 | 2/2004 |
| JP | 07252574 | 10/1995 |
| JP | 2000119782 | 4/2000 |
| JP | 2001254161 | 9/2001 |
| JP | 2002533572 | 10/2002 |
| JP | 2008506842 | 3/2008 |
| JP | 2008231475 | 10/2008 |

(Continued)

OTHER PUBLICATIONS

Sigworth, Geoffrey K., and Timothy A. Kuhn. "Grain refinement of aluminum casting alloys." International Journal of Metalcasting 1.1 (2007): 31-40.*
Chinese Application No. 201980072195.1 , Notice of Decision to Grant, Mailed on May 27, 2022, 6 pages.
Japanese Application No. 2021-522942 , Office Action, Mailed on May 17, 2022, 13 pages.
Korean Application No. 10-2021-7006090 , "Office Action", Jun. 29, 2022, 5 pages.
Canadian Application No. 3,109,052 , "Office Action", Sep. 21, 2022, 3 pages.

(Continued)

*Primary Examiner* — Jessee R Roe

(74) *Attorney, Agent, or Firm* — Kilpatrick Townsend & Stockton LLP

(57) ABSTRACT

A method of manufacturing an AA2xxx-series aluminium alloy plate product having improved fatigue failure resistance and a reduced number of flaws, the method comprising the following steps (a) casting an ingot of an aluminium alloy of the 2xxx-series, the aluminium alloy comprising (in wt. %): Cu 1.9 to 7.0, Mg 0.3 to 1.8, Mn up to 1.2, balance aluminium and impurities, each 0.05 max, total 0.15; (b) homogenizing and/or preheating the cast ingot; (c) hot rolling the ingot into a plate product by rolling the ingot with multiple rolling passes characterized in that, when at an intermediate thickness of the plate between 100 and 200 mm, at least one high reduction hot rolling pass is carried out with a thickness reduction of at least 15%; wherein the plate product has a final thickness of less than 60 mm. The invention is also related to an aluminium alloy product produced by this method.

16 Claims, 2 Drawing Sheets

(56) References Cited

FOREIGN PATENT DOCUMENTS

| | | |
|---|---|---|
| RU | 2354742 | 5/2009 |
| RU | 2379366 | 1/2010 |
| RU | 2443798 | 2/2012 |
| WO | 9859086 | 12/1998 |

OTHER PUBLICATIONS

EP19797192.2 , "Intention to Grant", Jan. 11, 2023, 9 pages.
JP2021-522942 , "Notice of Decision to Grant", Jan. 10, 2023, 4 pages.
Canadian Application No. 3, 109,052 , Office Action, Mailed on Jan. 20, 2022, 3 pages.
Chinese Application No. 201980072195.1 , Office Action, Mailed on Dec. 17, 2021, 20 pages.
Indian Application No. 202117015977 , "First Examination Report", Jan. 24, 2022, 7 pages.
Russian Application No. 2021107507 , Notice of Decision to Grant, Mailed on Nov. 18, 2021, 12 pages.
Russian Application No. 2021107507 , Office Action, Mailed on Sep. 3, 2021, 11 pages.
Zou et al., "Mechanical Theory and Structural Design of Steel Rolling", Metallurgical Industry Press, vol. 1, Apr. 30, 1993, 3 pages.
International Application No. PCT/EP2019/078844, International Search Report and Written Opinion, mailed on Jan. 21, 2020, 10 pages.
Korean Application No. 10-2021-7006090 , "Office Action", Jan. 31, 2023, 8 pages.
Brazilian Application No. 112021002715-7, "Office Action", Mar. 6, 2023, 5 pages.
Canadian Application No. 3,109,052, "Notice of Allowance", May 11, 2023, 1 page.
Korean Application No. 10-2021-7006090, "Notice of Decision to Grant", Aug. 29, 2023, 8 pages.
"Department of Defense Handbook:Metallic Materials and Elements for Aerospace Vehicle Structures", Department of Defense, Jan. 31, 2003, 28 pages.
"English translation of JP JP2000119782 A", Apr. 25, 2000, 31 pages.
"International Alloy Designations and Chemical Composition Limits for Wrought Aluminum and Wrought Aluminum Alloys", The Aluminum Association, Inc., Jan. 2015, 38 pages.
"Rolling Aluminum From the Mine Through the Mill", The Aluminum Association, 2007, 135 pages.
Driver et al., "Design of Aluminum Rolling Processes for Foil, Sheet, and Plate", Handbook of Metallurgical Process Design, Marcel Dekker, Inc., 2004, 48 pages.
European Application No. 19797192.2 , "Notice of Opposition", Feb. 27, 2024, 1 page.
European Application No. 19797192.2 , "Notice of Opposition", Feb. 16, 2024, 22 pages.

* cited by examiner

METHOD OF MANUFACTURING A 2XXX-SERIES ALUMINIUM ALLOY PLATE PRODUCT HAVING IMPROVED FATIGUE FAILURE RESISTANCE

FIELD OF INVENTION

The invention relates to a method of manufacturing a 2xxx-series aluminium alloy plate product having improved fatigue failure resistance and less flaws in an ultrasonic inspection of the plate product. The plate product can be ideally applied in aerospace structural applications, such as wing skin panels and fuselage structures, and other high strength end uses out of plates.

BACKGROUND OF THE INVENTION

It is known in the art to use heat treatable aluminum alloys in a number of applications involving relatively high strength such as aircraft fuselages, vehicular members and other applications. Aluminum Association alloys AA2xxx, such as AA2024, AA2324 and AA2524 are well known heat treatable aluminum alloys which have useful strength and toughness properties in T3, T39 and T351 temper.

The design of a commercial aircraft requires various properties for different types of structures on the aircraft. Especially for fuselage structure, for complex part machined out of plates, or lower wing skins it is necessary to have properties such as good resistance to crack propagation either in the form of fracture toughness or fatigue failure resistance. At the same time the strength of the alloy should not be reduced. A rolled alloy product either used as a sheet or as a plate with an improved damage tolerance will improve the safety of the passengers, will reduce the weight of the aircraft and thereby improve the fuel economy which translates to a longer flight range, lower costs and less frequent maintenance intervals.

Also, the reduction of internal defects of an extremely fine size 2 mm or less) is important for a rolled plate product since too much defects will lead to the rejection of the rolled plate for aerospace material. The proof of internal defects in a plate product can be carried out by ultrasonic inspection. Typically, in AA2xxx-series aluminum alloys, the discontinuity indications on an ultrasonic testing screen provide a reflection of the following types of defects: agglomerated gas porosity, non-metallic inclusions, metallic inclusions, salt particles, or very large primary phase segregation.

According to AMS-STD-2154 a plate product has to be rejected as aerospace material in the case of one or more ultrasonic indications having a size of 2.0 mm or larger, or if numerous indications of 1.2 to 1.9 mm size (depending on the number and distribution) appear.

Also, ASTM B594 is a standard practice for ultrasonic inspection of aluminium alloy wrought products. For the demands used in the aircraft industries, the levels are typically set to be ASTM B594 Class A.

It is known in the art to have AA2x24 alloy compositions with the following broad compositional range, in weight percent: Cu 3.7-4.9, Mg 1.2-1.8, Mn 0.15-0.9, Cr up to 0.15, Si<0.50, Fe<0.50, Zn<0.25, Ti<0.15, the balance aluminum and incidental impurities. Over time narrower windows have been developed within the broad AA2x24-series alloy range, in particular concerning lower combined Si and Fe ranges to improve on specific engineering properties.

JP-H-07252574 discloses a method of manufacturing an Al—Cu—Mg alloy comprising the steps of hot rolling after continuous casting and specifying the cooling rate at the time of solidification. In order to benefit from the high cooling rates in the continuous casting operation the contents of Fe and Si are controlled such that the sum of Fe+Si exceeds at least 0.4 wt. %.

U.S. Pat. No. 5,938,867 discloses a high damage tolerant Al—Cu alloy with a "2x24"-chemistry comprising essentially the following composition (in weight %): 3.8-4.9 Cu, 1.2-1.8 Mg, 0.3-0.9 Mn, not more than 0.30 Si, not more than 0.30 Fe, not more than 0.15 Ti, balance aluminum and unavoidable impurities, wherein the ingot is inter-annealed after hot rolling with an anneal temperature of between 385° C. and 468° C.

EP-0473122, as well as U.S. Pat. No. 5,213,639, disclose an aluminum base alloy comprising essentially the following composition (in weight %): 4.0-4.5 Cu, 1.2-1.5 Mg, 0.4-0.7 Mn, Fe<0.12, Si<0.1, the remainder aluminum, incidental elements and impurities, wherein such aluminum base is hot rolled, heated to above 487° C. to dissolve soluble constituents, and again hot rolled, thereby obtaining good combinations of strength together with high fracture toughness and a low fatigue crack growth rate. More specifically, U.S. Pat. No. 5,213,639 discloses a required inter-anneal treatment after hot rolling the cast ingot within a temperature range of 479° C. to 524° C. and again hot rolling the inter-annealed alloy wherein the alloy may contain optionally one or more elements from the group consisting of: 0.02-0.40 Zr, 0.01-0.5 V, 0.01-0.40 Hf, 0.01-0.20 Cr, 0.01-1.00 Ag, and 0.01-0.50 Sc. Such alloy appears to show at least 5% improvement over the above mentioned conventional AA2024-alloy in T-L fracture toughness and an improved fatigue crack growth resistance at certain AK-levels.

However, there is still a need for further improvement or further progress of fatigue failure resistance of AA2xxx-series alloys, including AA2x24-series alloys, as fatigue failure resistance is an important engineering parameter for aluminium alloy aerospace materials due to the cyclic stresses of an aircraft in service.

Thus, a need exists for an Al—Cu—Mg (Mn) type alloy having desirable strength, toughness and corrosion resistance properties as well as high fatigue failure resistance. A need also exists for aircraft structural parts that exhibit a high fatigue failure resistance and show less flaws in an ultrasonic inspection.

OBJECT OF THE INVENTION

It is an object of the present invention to provide a method for manufacturing an AA2xxx-series aluminium alloy plate having a high fatigue failure resistance compared to AA2xxx-series alloys and in particular AA2x24 aluminium alloy plate products of similar dimensions and temper produced by conventional methods.

It is another object of the invention to provide an aluminium alloy plate product having less flaws in an ultrasonic inspection over conventional AA2xxx-series aluminium alloys and in particular conventional AA2024 plate products of similar dimension and temper.

It is another object to provide aerospace structural members, such as lower wing skins from the improved fatigue resistant aluminium alloy plate having less flaws in ultrasonic inspection.

DESCRIPTION OF THE INVENTION

These and other objects and further advantages are met or exceed by the present invention providing a method of manufacturing an aluminium alloy rolled plate product having a final thickness of less than 60 mm, preferably less than 50 mm, ideally suitable for use as an aerospace plate product with improved failure resistance and a reduced number of flaws, the method comprising the steps, in that order, of:

(a) casting an ingot of an aluminium alloy of the AA2xxx-series;
(b) homogenizing and/or preheating the cast ingot;
(c) hot rolling the ingot into a plate product by rolling the ingot with multiple rolling passes characterized in that, when at an intermediate thickness of the plate between 100 and 200 mm, at least one high reduction hot rolling pass is carried out with a thickness reduction of at least 15%;
(d) optionally pre-stretching or applying a skin pass by cold rolling of the plate product;
(e) optionally solution heat treating and cooling to ambient temperature, preferably by means of quenching, of the plate product;
(f) optionally stretching the solution heat treated plate product;
(g) naturally ageing or artificially ageing of the plate product.

The method according to this invention can be applied to a wide range of AA2xxx-series aluminium alloys having a composition comprising, in wt. %:

| | |
|---|---|
| Cu | 1.9 to 7.0, |
| Mg | 0.3 to 0.8, |
| Mn | up to 1.2, |

balance being aluminium and impurities.

The term "comprising" in the context of the aluminium alloy is to be understood in the sense that the alloy may contain further alloying elements, as exemplified below.

In an embodiment the 2xxx-series aluminium alloy has a composition comprising, in wt. %:

| | |
|---|---|
| Cu | 1.9% to 7.0%, preferably 3.0% to 6.8%, more preferably 3.8% to 5.0%, |
| Mg | 0.30% to 1.8%, preferably 0.35% to 1.6%, |
| Mn | up to 1.2%, preferably 0.2% to 1.2%, more preferably 0.2 to 0.9%, |
| Si | up to 0.40%, preferably up to 0.25%, |
| Fe | up to 0.40%, preferably up to 0.25%, |
| Cr | up to 0.35%, preferably up to 0.10%, |
| Zn | up to 1.0%, |
| Ti | up to 0.15%, preferably 0.01% to 0.10%, |
| Zr | up to 0.25, preferably up to 0.12%, |
| V | up to 0.25%, |
| Li | up to 2.0% |
| Ag | up to 0.80%, |
| Ni | up to 2.5%, |

balance being aluminium and impurities. Typically, such impurities are present each ≤0.05%, total ≤0.15%.

The Cu is the main alloying element in 2xxx-series aluminium alloys, and for the method according to this invention it should be in a range of 1.9% to 7.0%. A preferred lower-limit for the Cu-content is about 3.0%, more preferably about 3.8%, and more preferably about 4.2%. A preferred upper-limit for the Cu-content is about 6.8%. In an embodiment the upper-limit for the Cu-content is about 5.0%.

Mg is another important alloying element and should be present in a range of 0.3% to 1.8%. A preferred lower-limit for the Mg content is about 0.35%. A more preferred lower-limit for the Mg content is about 1.0%. A preferred upper-limit for the Mg content is about 1.6%.

Mn is another important alloying element for many 2xxx-series aluminium alloys and should be present in a range of up to 1.2%. In an embodiment the Mn-content is in a range of 0.2% to about 1.2%, and preferably 0.2% to about 0.9%, Zr can be present is a range of up to 0.25%, and preferably is present in a range up to 0.12%.

Cr can be present in a range of up to 0.35%, preferably in a range of up to 0.15%. In an embodiment there is no purposive addition of Cr and it can be present up to 0.05%, and preferably is kept below 0.02%.

Silver (Ag) in a range of up to about 0.8% can be purposively added to further enhance the strength during ageing. A preferred lower limit for the purposive Ag addition would be about 0.05% and more preferably about 0.1%. A preferred upper limit would be about 0.7%.

In an embodiment the Ag is an impurity element and it can be present up to 0.05%, and preferably up to 0.03%.

Zinc (Zn) in a range of up to 1.0% can be purposively added to further enhance the strength during ageing. A preferred lower limit for the purposive Zn addition would be 0.25% and more preferably about 0.3%. A preferred upper limit would be about 0.8%.

In an embodiment the Zn is an impurity element and it can be present up to 0.25%, and preferably up to 0.10%.

Lithium (Li) in a range of up to about 2% can be purposively added to further enhance damage tolerance properties and to lower the specific density of the alloy product. A preferred lower limit for the purposive Li addition would be about 0.6% and more preferably about 0.8%. A preferred upper limit would be about 1.8%.

In an embodiment the Li is an impurity element and it can be present up to 0.10%, and preferably up to 0.05%.

Nickel (Ni) can be added up to about 2.5% to improve properties at elevated temperature. When purposively added a preferred lower-limit is about 0.75%. A preferred upper-limit is about 1.5%. When Ni is purposively added, it is required that also the Fe content in the aluminium alloy is increased to a range of about 0.7% to 1.4%.

In an embodiment the Ni is an impurity element and it can be present up to 0.10%, and preferably up to 0.05%.

Vanadium (V) in a range of up to 0.25% can be purposively added, and preferably to up about 0.15%. A preferred lower limit for the purposive V addition would be 0.05%.

In an embodiment the V is an impurity element and it can be present up to about 0.05%, and preferably is kept to below about 0.02%.

Ti can be added up to 0.15 wt. % to serve as a grain refiner. Ti is commonly added to aluminium alloys together with boron due to their synergistic grain refining effect. A preferred lower limit for the purposive Ti addition would be about 0.01%. A preferred upper limit would be about 0.10%, preferably about 0.08%.

Fe is a regular impurity in aluminium alloys and can be tolerated up to 0.4%. Preferably it is kept to a level of up to about 0.25%, and more preferably up to about 0.15%, and most preferably up to about 0.10%. However, there is no need to lower the Fe-content below 0.05 wt. %.

Si is also a regular impurity in aluminium alloys and can be tolerated up to about 0.4%. Preferably it is kept to a level of up to about 0.25%, and more preferably up to about 0.15%, and most preferably up to about 0.10%. However, there is no need to lower the Si-content below 0.05 wt. %.

In an embodiment the 2xxx-series aluminium alloy has a composition consisting of, in wt. %: Cu 1.9% to 7.0%, Mn up to 1.2%, Mg 0.3% to 1.8%, Zr up to 0.25%, Ag up to 0.8%, Zn up to 1.0%, Li up to 2%, Ni up to 2.5%, V up to 0.25%, Ti up to 0.15%, Cr up to 0.35%, Fe up to 0.4%, Si up to 0.4%, balance aluminium and impurities each <0.05% and total <0.15%, and with preferred narrower compositional ranges as herein described and claimed.

In a further embodiment, the aluminium alloy has a chemical composition within the ranges of AA2024, AA2324 and AA2524, and modifications thereof.

In a particular embodiment, the aluminium alloy has a chemical composition within the ranges of AA2024.

As will be appreciated herein, except as otherwise indicated, aluminium alloy designations and temper designations refer to the Aluminium Association designations in Aluminium Standards and Data and the Registration Records, as published by the Aluminium Association in 2018, and are well known to the person skilled in the art.

For any description of alloy compositions or preferred alloy compositions, all references to percentages are by weight percent unless otherwise indicated.

The terms "≤" and "up to" and "up to about", as employed herein, explicitly include, but are not limited to, the possibility of zero weight-percent of the particular alloying component to which it refers. For example, up to 0.10% Cr may include an alloy having no Cr.

In an embodiment of the method of the present invention a very mild cold rolling step (skin rolling or skin pass) after to the solution heat-treatment step can be carried out with a reduction of less than 1%, preferably less than 0.5%, to improve the flatness of the final product. Preferably, no cold rolling is carried out with a reduction of more than 1% when the plate is rolled to final thickness to avoid at least partial recrystallization during a subsequent solution heat treatment step resulting in adversely affecting the balance of engineering properties in the final plate product.

In an alternative embodiment of the method of the present invention, the plates can be pre-stretched prior to the solution heat-treatment step. This pre-stretching step can be carried out with a reduction of up to 3%, preferably between 0.5% to 1%, to improve the flatness of the final product.

The final thickness of the rolled plate product is less than 60 mm, preferably less than 50 mm, preferably less than 45 mm, more preferably less than 40 mm, and most preferably less than 35 mm. In very useful embodiments, the final thickness of the plate product is more than 10 mm, preferably more than 12 mm, more preferably more than 15 mm and most preferably more than 19 mm.

The aluminium alloy as described herein can be provided in process step (a) as an ingot or slab or billet for fabrication into a suitable wrought product by casting techniques regular in the art for wrought products, e.g. DC-casting, EMC-casting, EMS-casting, and preferably having a thickness in a range of 300 mm or more, for example 400 mm, 500 mm or 600 mm. On a less preferred basis slabs resulting from continuous casting, e.g. belt casters or roll casters, also may be used, which in particular may be advantageous when producing thinner gauge end products. Grain refiners such as those containing titanium and boron, or titanium and carbon, may be used as is well-known in the art. After casting the rolling alloy stock, the ingot is commonly scalped to remove segregation zones near the cast surface of the ingot.

Next, the ingot is homogenized and/or preheated. It is known in the art that the purpose of a homogenisation heat treatment has at least the following objectives: (i) to dissolve as much as possible coarse soluble phases formed during solidification, and (ii) to reduce concentration gradients to facilitate the dissolution step. A preheat treatment achieves also some of these objectives. A typical pre-heat treatment for AA2xxx-series alloys would be a temperature of 420° C. to 505° C. with a soaking time in the range of 3 to 50 hours, more typically for 3 to 20 hours.

Firstly, the soluble eutectic phases such as the S-phase in the alloy stock are dissolved using regular industry practice. This is typically carried out by heating the stock to a temperature of less than 500° C. as S-phase eutectic phase ($Al_2MgCu$-phase) have a melting temperature of about 507° C. in AA2xxx-series alloys. In AA2x24-series alloys there is also a θ-phase ($Al_2Cu$ phase) having a melting point of about 510° C. As it is known in the art this can be achieved by a homogenisation and/or preheating treatment in said temperature range and allowing to cool to the hot working temperature, or after homogenisation the stock is subsequently cooled and reheated before hot rolling. The regular homogenisation and/or preheating process can also be done in one or more steps if desired, and which are typically carried out in a temperature range of 400° C. to 505° C. For example in a two step process, there is a first step between 480° C. and 500° C., and a second step between 470° C. and 490° C., to optimise the dissolving process of the various phases depending on the exact alloy composition. In either case, the segregation of alloying elements in the material as cast is reduced and soluble elements are dissolved. If the treatment is carried out below 400° C., the resultant homogenisation effect is inadequate. If the temperature is above 505° C., eutectic melting might occur resulting in undesirable pore formation.

The soaking time at the homogenisation temperature according to industry practice is alloy dependent as is well known to the skilled person, and is commonly in the range of 1 to 50 hours. A preferred time of the above heat treatment is 2 to 30 hours. Longer times are normally not detrimental. Homogenisation is usually performed at a temperature above 485° C., and a typical homogenisation temperature is 493° C. A typical preheat temperature is in the range of 440° C. to 460° C. with a soaking time in the range of 3 to 15 hours. The heat-up rates that can be applied are those which are regular in the art.

Following the homogenization and/or preheat practice the ingot is hot rolled. Hot rolling of the ingot is carried out with multiple hot rolling passes, usually in a hot rolling mill. The number of hot rolling passes is typically between 15 and 35, preferably between 20 and 29. When the hot rolled plate product has reached an intermediate thickness of between 100 mm and 200 mm, preferably between 120 mm and 180 mm, the method applies at least one high reduction hot rolling pass with a thickness reduction of at least about 15%, preferably of at least about 20% and most preferred of at least about 25%. In useful embodiments, the thickness reduction in this high reduction pass is less than 70%, preferably less than 55%, more preferred less than 40%. The "thickness reduction" of a rolling pass, also referred to as reduction ratio, is preferably the percentage by which the thickness of the plate is reduced in the individual rolling pass.

Such an at least one high reduction hot rolling pass is not carried out in conventional industrial hot rolling practices when producing AA2xxx-series plate products. Therefore, the hot rolling passes between 100 mm and 200 mm according to a non-limitative example of the invention could be described as follows (looking at the plate intermediate thickness): 199 mm-192 mm-183 mm-171 mm-127 mm-125 mm-123 mm. The high reduction hot rolling pass from 171 mm to 127 mm corresponds to a thickness reduction of about 26%. For aluminium alloy plates produced by a conventional hot rolling process, the thickness reduction of each hot rolling pass is typically between 1% and 12% when at the intermediate thickness between 100 mm and 200 mm. Accordingly, the hot rolling passes between 100 mm and 200 mm according to an example of the conventional method could be described as follows (looking at the plate intermediate thickness): 200 mm-188 mm-177 mm-165 mm-154 mm-142 mm-131 mm. Accordingly, the method according to the invention defines a hot rolling step wherein at least one high reduction hot rolling pass is carried out. This high reduction pass is defined by a thickness reduction of at least about 15%, preferably of at least about 20%, and more preferred of at least about 25%.

The hot rolling passes of the method of this invention before and after the high reduction pass have a reduction ratio that is comparable with the reduction ratio of the hot rolling passes of the conventional hot rolling method. Accordingly, each hot rolling pass before and after the high reduction hot rolling pass could have a thickness reduction between 1% and 12%. Since the thickness reduction varies depending on the thickness of the plate, e.g. thick plates having more than 300 mm or thin plates having less than 60 mm, it is a feature of the claimed method that the high reduction step is carried out when the intermediate thickness of the plate product has reached between 200 mm and 100 mm, preferably 180 mm to 120 mm, most preferred between 150 mm and 170 mm. This thickness is chosen to ensure that the high deformation/shear is consistent throughout the entire plate product thickness. For plate products thicker than 200 mm it is more difficult to ensure a consistent deformation throughout the entire plate. Typically, in thicker plate products there would be less deformation in the center (half thickness) of the plate product than at the quarter thickness position or in the subsurface area.

Preferably, one high reduction hot rolling pass is carried out. In an alternative embodiment, two or more, e.g. three, high reduction hot rolling passes are carried out.

In an alternative embodiment, the product receives two hot rolling steps. In this embodiment, the ingot is hot rolled to an intermediate thickness in a range of 100 to 140 mm receiving a high reduction pass. Then the plate product is reheated to the temperature of the homogenization and/or pre-heating step, i.e. between 400° C. to 505° C. In a preferred embodiment, the re-heating step can be carried out in two or more steps if desired. This re-heating step minimizes or avoids soluble constituent or secondary phase particles that may result from the first part of hot rolling. This re-heating step has the effect of putting most of the Cu and Mg into solid solution. Thereafter a second series of hot rolling steps is carried out to achieve the final thickness of the plate product. These second hot rolling steps do not include a high reduction pass.

In both embodiments, i.e. homogenization and/or preheat or homogenization and/or preheat with a re-heating step after the first hot rolling to intermediate thickness it is possible to maintain an exit temperature of the hot rolling mill of more than 385° C., preferably more than 400° C., more preferred more than 410° C.

It has been found that, in the case of manufacturing a plate product having a final thickness of less than 60 mm, also a deformation rate during the hot rolling process has an influence on the final plate product properties. Therefore, the deformation rate during the at least one high reduction pass in a useful embodiment of the method is preferably lower than $<0.77\ s^{-1}$, preferably $\leq 0.6\ s^{-1}$. This intense shearing is believed to cause a break-up of the constituent particles, e.g. Fe-rich intermetallics.

The deformation rate during hot rolling per rolling pass can be described by the following formula:

$$\dot{p} = \frac{h_1 v_1}{h_0^2} \tan\left[\arccos\left(1 - \frac{h_0 - h_1}{2R}\right)\right]$$

wherein $\dot{p}$ deformation rate (in $s^{-1}$)

$h_0$ entry thickness of the plate (in mm)

$h_1$ exit thickness of the plate (in mm)

$v_1$ rolling speed of the working rolls (in mm/s)

R radius of the working rolls (in mm).

The deformation rate is the change of strain (deformation) of a material with respect to time. It is sometimes also referred to as "strain rate". The formula shows that not only the entry thickness and the exit thickness of the aluminium alloy plate, but also the rolling speed of the working rolls has an influence on the deformation rate.

For conventional industrial scale hot rolling practices, the deformation rate of each rolling pass is typically equal to or more than $0.77\ s^{-1}$. As already outlined above, according to an embodiment of the method according to this invention during the high reduction pass the deformation rate is reduced to $<0.77\ s^{-1}$, preferably to $\leq 0.6\ s^{-1}$. By using a low deformation rate, it is possible to achieve a more intense shearing within the plate material.

Furthermore, the aluminium alloy plate product manufactured by the present invention can be, if desired, cold rolled or pre-stretched to improve flatness, solution heat treated (SHT), cooled, preferably by means of quenching, stretched or cold rolled, and aged after the rolling to final gauge. Pre-stretching can be applied in a range of 0.5 to 1% of the original length of the plate, if desired, to make the plate product flat enough to allow subsequent ultrasonic testing for quality control reasons. If a solution heat treatment (SHT) is carried out, the plate product should be heated to a temperature in the range of 460° C. to 505° C., for a time sufficient for solution effects to approach equilibrium, with typical soaking times in the range of 5 to 120 minutes. The solution heat treatment is typically carried out in a batch furnace. Typical soaking times at the indicated temperature is in the range of 5 to 30 minutes. After the set soaking time at the elevated temperature, the plate product should be cooled to a temperature of 175° C. or lower, preferably to ambient temperature, to prevent or minimize the uncontrolled precipitation of secondary phases, e.g. $Al_2CuMg$ and $Al_2Cu$. On the other hand, the cooling rates should not be too high in order to allow for a sufficient flatness and low level of residual stresses in the plate product. Suitable cooling rates can be achieved with the use of water, e.g. water immersion or water jets.

After cooling to ambient temperature, the plate products may be further cold worked, for example, by stretching in the range of 0.5% to 8% of its original length in order to relieve residual stresses therein and to improve the flatness of the product. Preferably, the stretching is in the range of 0.5% to 4%, more preferably of 0.5% to 5%, and most preferably 0.5% to 3%.

After cooling the plate product is naturally aged, typically at ambient temperatures, and/or alternatively the plate product can be artificially aged. The artificial ageing can be of particular use for higher gauge products. All ageing practices known in the art and those which may be subsequently developed can be applied to the AA2xxx-series alloy products obtained by the method according to this invention to develop the required strength and other engineering properties. Typical tempers would be for example T4, T3, T351, T39, T6, T651, T8, T851, and T89.

In a particular preferred embodiment, the plate product is naturally aged to a T3 temper, preferably to a T39 or T351 temper.

An advantage of the present invention is that the aluminium alloy plate product shows improved fatigue failure resistance by using at least one high reduction hot rolling pass at intermediate gauge during the hot rolling operation. This superior fatigue behavior is achieved without limiting the content of Fe and Si to extremely low impurity levels (i.e. to less than 0.05 wt. %).

Furthermore, the aluminium alloy plate product produced by the claimed method shows less flaws in an ultrasonic detection. This is achieved by using the method of the present invention, i.e. a high reduction hot rolling step.

The AA2000-series alloy plate product when manufactured according to this invention is suitable for aircraft applications such as a wing skins or an aircraft fuselage panels.

In a particular embodiment the aluminium alloy plate product is used as a wing panel or member, more in particular as an upper wing panel or member.

Accordingly, the plate product manufactured according to the invention provides improved properties compared to a plate product manufactured according to conventional standard methods for this type of aluminium alloys having otherwise the same dimensions and processed to the same temper.

BRIEF DESCRIPTION OF THE FIGURES

Embodiments of the invention will now be described by way of non-limiting examples, and comparative examples representative of the state of the art will also be given.

EXAMPLES

Example 1

Figure 1:
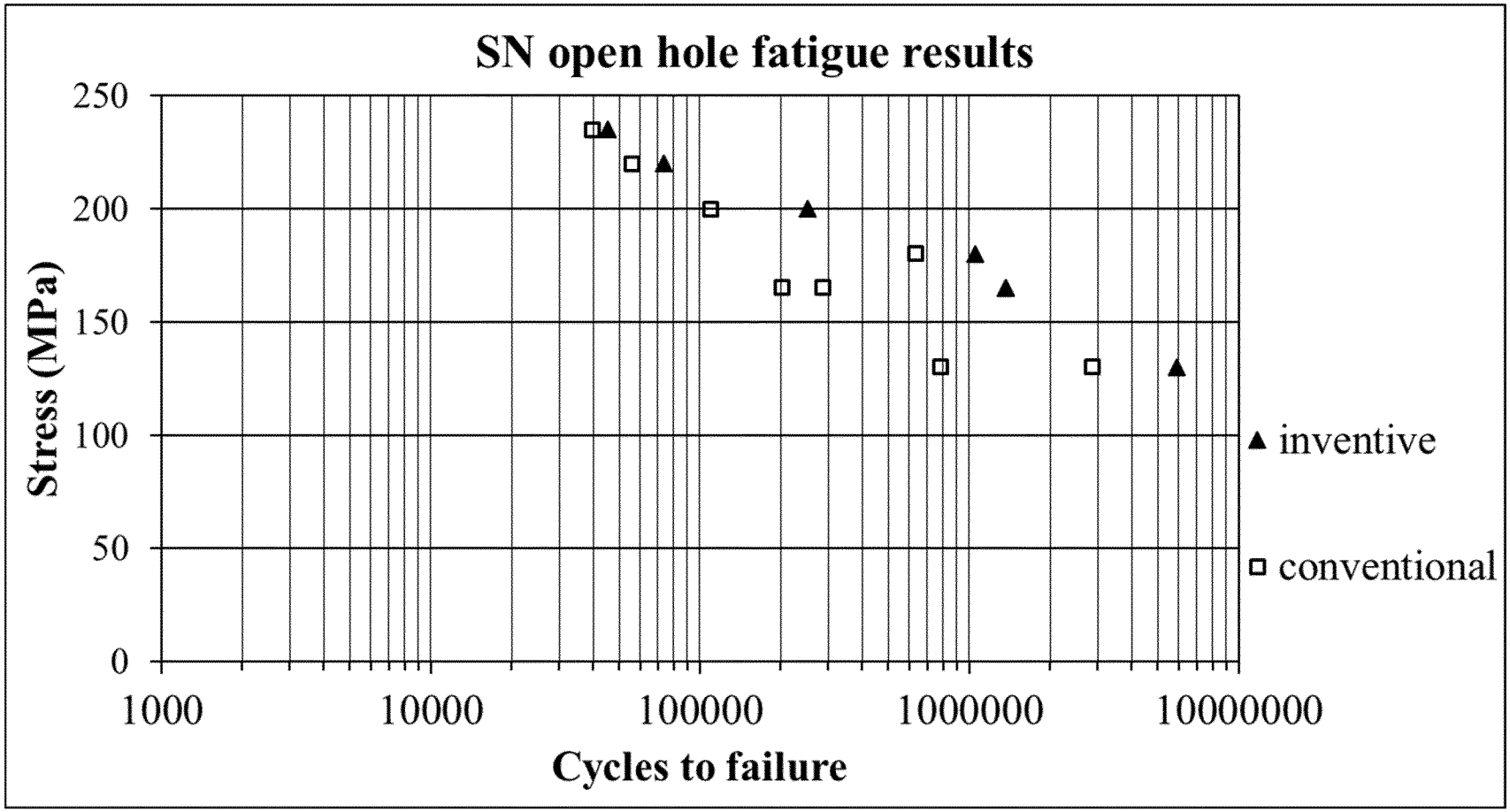
FIG. 1 is graph of maximum net stress versus cycles to failure for plates prepared according to the method of this invention and plates prepared by conventional methods.
Figure 2:
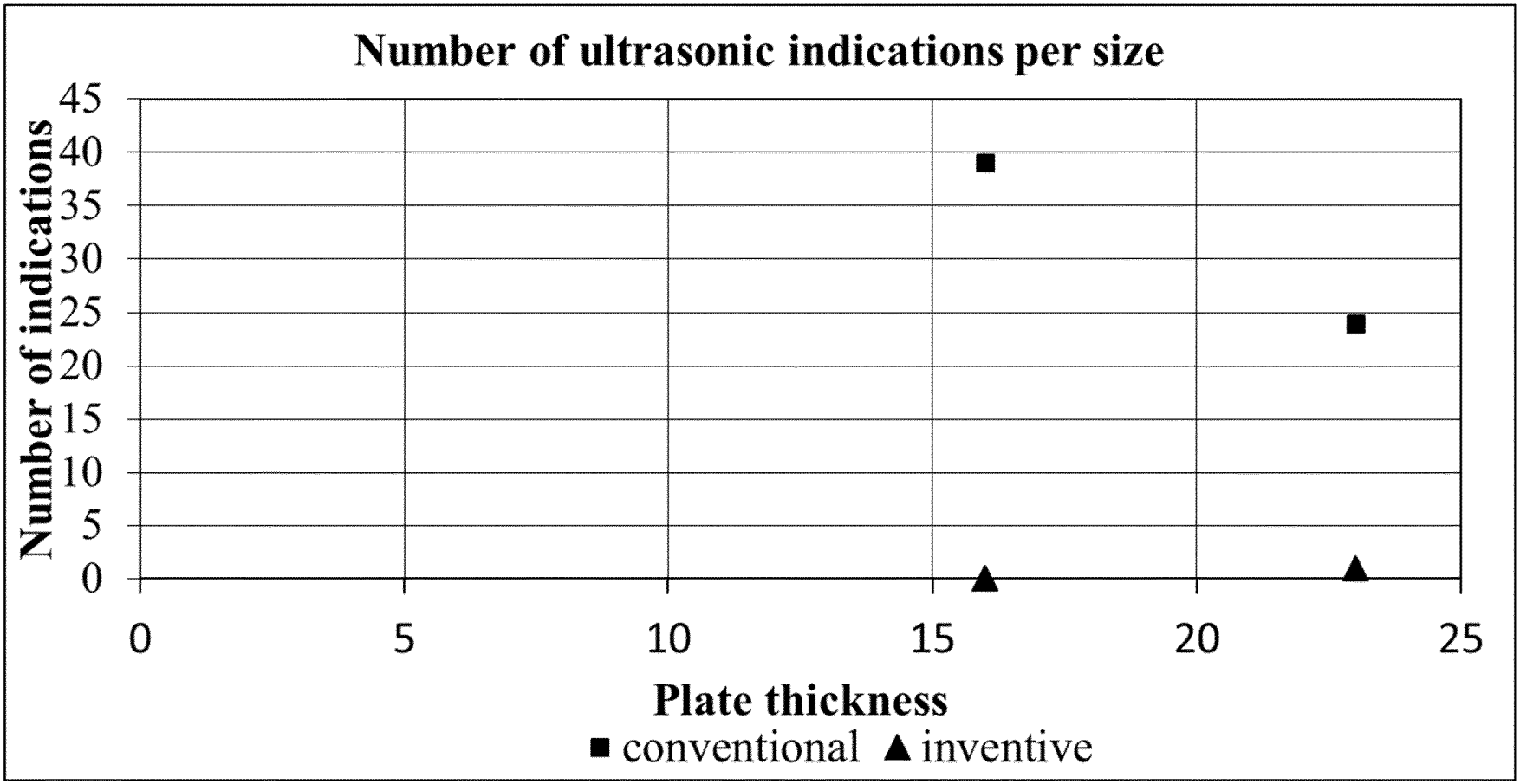
FIG. 2 is a graph showing the number of ultrasonic indications versus the plate thickness from plates prepared according to the method of this invention and plates prepared by conventional methods.

Rolling ingots have been DC-cast of the aluminium alloy AA2024, with a composition (in wt. %, balance aluminium and impurities) as given in Table 1.

TABLE 1

| Ingot Lot No. | Si | Fe | Cu | Mn | Mg | Zn | Ti |
|---|---|---|---|---|---|---|---|
| A, B | 0.07 | 0.03 | 4.0 | 0.5 | 1.3 | 0.02 | 0.03 |

The rolling ingots have a thickness at the start of about 330 mm. Homogenization and pre-heating of the ingots were carried out in a two-step procedure, the first step at 495° C. for 18-24 hours and the second step at 485° C. for 1 to 16 hours (pre-heat). Then the ingots were hot rolled to an intermediate thickness of 100-140 mm (first hot rolling), wherein ingot A was processed according to the invention, i.e. this ingot received a high reduction pass during the first hot rolling. At about 170 mm ingot A was reduced in thickness with a reduction of about 26% (171 mm to 127 mm). The rolling speed during this high reduction pass was about 25 m/min giving a deformation rate of 0.52 $s^{-1}$.

Ingot B was processed according to a conventional hot rolling method (a thickness reduction between 3% and 8% for each hot rolling pass between 300 and 120 mm). The rolling speed during the standard hot rolling passes was between 60 m/min (entry thickness 177 mm) and 100 m/min (entry thickness 131 mm) giving a deformation rate of between 0.77 $s^{-1}$ and 1.56 $s^{-1}$. The exit temperature after the first hot rolling series is above 400° C. At an intermediate thickness of 120 mm (lot A and lot B) both plates were heated to 490° C. for 24 to 30 hours and then set to 485° C. for 1 to 12 hours. After this re-heating the plates were hot rolled to the final thickness of 23 mm (second hot rolling series). The exit temperature after the second hot rolling is above 400° C.

Plate A received 24 hot rolling passes, wherein the high reduction pass was pass number 12. Plate B received 26 hot rolling passes without a high reduction pass. As already outlined above, both plates were first hot rolled to intermediate thickness between 100 and 140 mm. Plate A was subjected to the second pre-heating after pass No. 15 and Plate B was subjected to the second pre-heating after pass No. 17. Both plates have a final thickness of 23 mm after the hot rolling process. After the hot rolling steps both plates were solution heat treated at a temperature of about 495° C. and quenched. Then, they received a rolling skin pass for flatness improvement and were stretched for about 2-3%. A naturally ageing step was applied for at least 5 d, bringing the plate products to a T351 condition.

Fatigue testing was performed according to DIN-EN-6072 by using a single open hole test coupon having a net stress concentration factor Kt of 2.3. The test coupons were 150 mm long by 30 mm wide, by 3 mm thick with a single hole 10 mm in diameter. The hole was countersunk to a depth of 0.3 mm on each side. The test coupons were stressed axially with a stress ratio (min load/max load) of R=0.1. The test frequency was 30 Hz and the tests were performed in high humidity air (RH≥90%). The individual results of these tests are shown in Table 2 and FIG. 1.

TABLE 2

| Alloy | A | B |
|---|---|---|
| Temper | T351 | T351 |
| final thickness of plate (mm) | 23 | 23 |
| High reduction pass | yes | no |
| inventive method | yes | no |
| | Cycles to failure | Cycles to failure |

TABLE 2-continued

| Alloy | | A | B |
|---|---|---|---|
| max net stress [MPa] | 235 | 45.490 | 39.906 |
| | 220 | 73.690 | 55.573 |
| | 200 | 252.233 | 109.719 |
| | 180 | 1.050.476 | 634.427 |
| | 165 | 1.364.233 | 202.649 |
| | 165 | | 287.674 |
| | 130 | 5.862.397 | 2.855.895 |
| | 130 | | 780.995 |

FIG. 1 illustrates that by using the method of this invention, it is possible to significantly improve the fatigue life and thus the fatigue failure resistance with respect to AA2xxx alloy plates prepared by conventional methods. For example, at an applied net section stress of 200 MPa, plate A has a lifetime of 252.233 cycles representing a 2.3 times improvement in lifetime compared to alloy B which has a life time of 109.719 cycles.

Example 2

An ultrasonic inspection of the alloy plates given in Table 3 have been carried out according to AMS-STD-2154. Test plates were used having a thickness of 16 mm or 23 mm. The composition (in wt. % and balance aluminium and impurities) is given below in Table 3.

TABLE 3

| Ingot | final thickness | Si | Fe | Cu | Mn | Mg | Zn | Ti |
|---|---|---|---|---|---|---|---|---|
| Lot | | | | | | | | |
| A, B | 23 mm | 0.07 | 0.03 | 4.0 | 0.5 | 1.3 | 0.02 | 0.03 |
| C, D, E, F | 16 mm | 0.07 | 0.03 | 4.0 | 0.5 | 1.3 | 0.02 | 0.03 |

The rolling ingots have a thickness at the start of about 330 mm. Plates A and B were produced as outlined above in Example 1, i.e. plate B received 26 hot rolling passes without a high reduction pass and plate A received 24 hot rolling passes including a high reduction pass at about 170 mm.

Regarding lots C, D, E and F the rolling ingots have a thickness at the start of about 330 mm. Homogenization and pre-heating, first hot rolling, second pre-heating and second hot rolling of the ingots were carried out as outlined in Example 1, i.e. at about 170 mm lots E and F were reduced in thickness with a reduction of about 26% (171 mm to 127 mm) and lots C and D were processed according to a conventional hot rolling method. All plates have a final thickness of 16 mm after the hot rolling process. After the hot rolling steps the plates were pre-stretched in a range of 0.5% to 1% to improve the flatness of the plates. Then these were solution heat treated at a temperature of 495° C., quenched and again stretched for about 2-3%. A naturally ageing step was applied, bringing the plate products to a T351 condition.

The following Table 4 shows the number of ultrasonic (US) indications that the plates show. The plates having a final thickness of 16 mm have a dimension of 16 mm×1000 mm×12000 mm and the plates having a final thickness of 23 mm have a dimension of 23 mm×1500 mm×17000 mm.

TABLE 4

| LOT Nos. | final thickness | High reduction pass | Number of US indications per size range <1.2 mm | 1.2-1.9 mm | ≥2.0 mm | Sum of US indications |
|---|---|---|---|---|---|---|
| B | 23 mm | no | 18 | 6 | 0 | 24 |
| A | 23 mm | yes | 0 | 1 | 0 | 1 |
| C | 16 mm | no | 20 | 7 | 0 | 27 |
| D | 16 mm | no | 22 | 16 | 1 | 39 |
| E | 16 mm | yes | 0 | 0 | 0 | 0 |
| F | 16 mm | yes | 0 | 0 | 0 | 0 |

From this Table it is evident that the plate products of lots A, E and F prepared by the method of the present invention, i.e. receiving the high reduction pass, show a reduced number of flaws (see sum of US indications) detected with ultrasonic inspection according to AMS-STD-2154.

The invention is not limited to the embodiments described before, which may be varied widely within the scope of the invention as defined by the appending claims.

The invention claimed is:

1. A method of manufacturing an AA2xxx-series aluminium alloy plate product, the method comprising the following steps:

(a) casting an ingot of an aluminium alloy of the AA2xxx-series;

(b) homogenizing and/or preheating the cast ingot;

(c) hot rolling the ingot into a plate product by rolling the ingot with multiple rolling passes, wherein when the plate product has reached an intermediate thickness of between 100 and 200 mm, at least one high reduction hot rolling pass is carried out with a thickness reduction of at least 15%, wherein each hot rolling pass before and after the high reduction hot rolling pass has a thickness reduction between 1% and 12%;

and wherein the plate product has a final thickness of less than 60 mm.

2. The method according to claim 1, wherein the method further comprises the steps of:

(d) optionally pre-stretching or applying a skin pass by cold rolling of the plate product after the hot rolling;

(e) solution heat treating the plate product;

(f) cooling, of the solution heat treated plate product;

(g) optionally stretching the solution heat treated plate product; and (h) natural ageing or artificially aging the solution heat treated and cooled plate product.

3. The method according to claim 1, wherein the high reduction hot rolling pass is carried out with a reduction of at least 20%.

4. The method according to claim 1, wherein a deformation rate during the high reduction pass is $<0.77\ s^{-1}$.

5. The method according to claim 1, wherein the intermediate thickness of the plate before the high reduction pass is carried out between 120 and 180 mm.

6. The method according to claim 1, wherein the 2xxx aluminium alloy has a composition comprising, in wt. %:

| | |
|---|---|
| Cu | 1.9 to 7.0, |
| Mg | 0.3 to 1.8, |
| Mn | up to 1.2, |

balance aluminium and impurities.

7. The method according to claim 1, wherein the 2xxx aluminium alloy has a composition comprising, in wt. %:

| | |
|---|---|
| Cu | 1.9 to 7.0, |
| Mg | 0.3 to 1.8, |
| Mn | up to 1.2, |
| Fe | up to 0.40, |
| Si | up to 0.40, |
| Ti | up to 0.15, |
| Zr | up to 0.25, |
| Zn | up to 1.0, |
| Li | up to 2.0, |
| Ni | up to 2.5, |
| Ag | up to 0.80, |
| V | up to 0.25, |
| Cr | up to 0.35, |

balance aluminium and impurities.

8. The method according to claim 1, wherein the 2xxx aluminium alloy has a Cu-content of 3.0% to 6.8%.

9. The method according to claim 1, wherein the 2xxx aluminium alloy has a Mg-content of 0.35% to 1.6%.

10. The method according to claim 1, wherein the 2xxx aluminium alloy has a Mn-content of 0.2% to 1.2%.

11. The method according to claim 1, wherein the Ti-content is within a range of 0.01% to 0.10 wt. %.

12. The method according to claim 1, wherein the aluminium alloy has a composition in accordance with AA2024.

13. The method according to claim 1, wherein the final thickness of the plate is less than 50 mm.

14. The method according to claim 1, wherein the final thickness of the plate product is more than 10 mm.

15. The method according to claim 1, wherein in the method step (c) the hot rolling mill exit temperature is more than 385° C.

16. The method according to claim 1, wherein the plate product is naturally aged to a T3 temper.

* * * * *